United States Patent [19]

Kita

[11] Patent Number: 4,525,075

[45] Date of Patent: Jun. 25, 1985

[54] ELECTRONIC WRISTWATCH WITH PRINTER FUNCTION

[75] Inventor: Kazunori Kita, Tokyo, Japan

[73] Assignee: Casio Computer Co., Ltd., Tokyo, Japan

[21] Appl. No.: 669,660

[22] Filed: Nov. 8, 1984

[30] Foreign Application Priority Data

Jul. 27, 1984 [JP] Japan ..... 59-155380

[51] Int. Cl.[3] ..... G04B 47/00; G04B 45/00

[52] U.S. Cl. ..... 368/10; 368/41

[58] Field of Search ..... 368/10, 41, 42, 44, 368/46, 71

[56] References Cited

U.S. PATENT DOCUMENTS

| | | | |
|---|---|---|---|
| 4,164,038 | 8/1979 | Nachtigal | 368/10 |
| 4,195,220 | 3/1980 | Bristol et al. | 368/46 |
| 4,361,874 | 11/1982 | Yasuda | 368/28 |
| 4,451,896 | 5/1984 | Pomerlead et al. | 368/10 |

*Primary Examiner*—Vit W. Miska

*Attorney, Agent, or Firm*—Frishauf, Holtz, Goodman and Woodward

[57] ABSTRACT

An electronic wristwatch with a printer has a printing head which is arranged inside a wristwatch case with a recording paper loading portion and which performs printing on the recording paper. The printing head is moved by an operation member, and a displacement thereof is detected by a detecting portion. A print control circuit controls printing of the printing head in accordance with a speed corresponding to the displacement detected by the detecting portion.

6 Claims, 28 Drawing Figures

ELECTRONIC WRISTWATCH WITH PRINTER FUNCTION

BACKGROUND OF THE INVENTION

The present invention relates to an electronic wristwatch with a printer function.

Electronic wristwatches display time with pointers or a digital display device and generally have other functions associated with time such as a stop watch function or a plurality of alarm functions.

Recently, electronic wristwatches have acquired other functions such as a calculation function, a schedule table preparation function, or a game function. Various information relating to those functions is displayed by an optical display device in place of the time for confirmation by a user of the wristwatch.

In an electronic wristwatch of this type, desired information can only be displayed and not recorded. In order to record such information, the user must copy it on a sheet of paper or the like.

In order to prevent this problem, the wristwatch can be provided with a printer to print desired information. However, when a printer is assembled in an electronic wristwatch, the watch inevitably becomes large and heavy, and thus become impractical.

A conventional printer uses a stepping motor or the like to move a printing head. In order to convert the rotational movement of the stepping motor into linear movement, a conversion mechanism such as a spiral bar, a belt, a wire and the like must be driven through a gear mechanism.

Printing paper must also be fed in synchronism with the movement of the printing head and the printing timing. Thus, feeding of printing paper also requires a complex gear mechanism.

When a printer is assembled in an electronic wristwatch, the wristwatch becomes large and heavy as described above. In addition, power consumption is increased, and the cell life is shortened.

SUMMARY OF THE INVENTION

The present invention has been made in consideration of this and has as its object to provide an electronic wristwatch with a printer which has low power consumption and which is simple in construction and small in size.

In order to achieve the above object of the present invention, there is provided an electronic wristwatch with a printer comprising: a wristwatch case means having a recording paper loading portion; a printing head means, arranged inside said wristwatch case, for printing on the recording paper; an operation member means, manually operated, for moving said printing head means; detecting means for detecting a displacement of said printing head which is performed by manual operation of said operation member; and printing controlling means for controlling the printing of said printing head at a speed corresponding to the displacement detected by said detecting means. In an electronic wristwatch with a printer having the above configuration, the operation of the printing head can be controlled in accordance with the amount of movement of the head upon manual operation and without requiring a motor for feeding recording paper. Therefore, the printer can be rendered compact in size. Even if this compact printer is assembled in the wristwatch case, the wristwatch need not be rendered big. The weight and the power consumption of the wristwatch can be kept low, thus increasing the cell life.

DETAILED DESCRIPTION OF THE PREFERRED EMBODIMENTS

Figure 1:
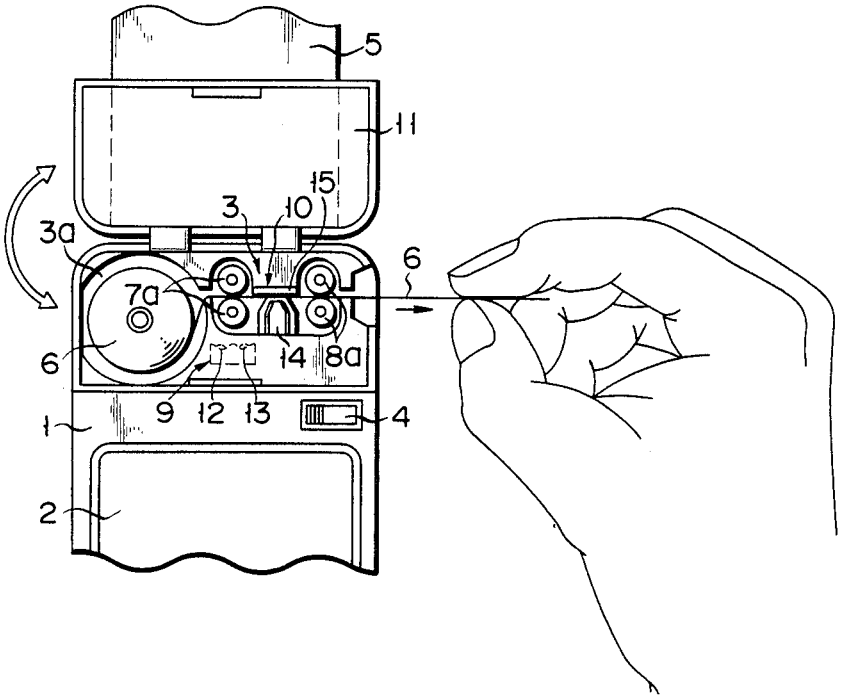
FIG. 1 is a plan view showing the main part of an electronic wristwatch with a printer according to an embodiment of the present invention, wherein recording paper is pulled manually.
Figure 2:
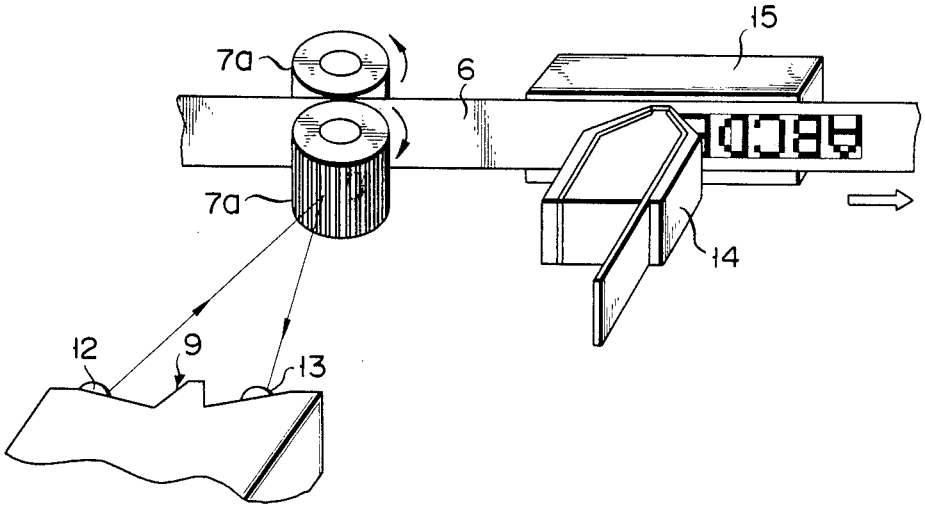
FIG. 2 is an enlarged view of the main part of a drive portion shown in FIG. 1.

FIG. 1 is a plan view showing a main part of an electronic wristwatch with a printer according to an embodiment of the present invention, and FIG. 2 is an enlarged perspective view of a drive portion thereof. Referring to these figures, reference numeral 1 denotes a wristwatch case. A display portion 2 for displaying information such as time, a printer 3, and a power source switch 4 for the printer 3 are arranged in the wristwatch case 1. A wristwatch band 5 is attached to the rear end of the wristwatch case 1.

When recording paper 6 is pulled outside the wristwatch case 1, the printer 3 prints one line on the paper 6 in its pulling direction in accordance with the speed at which the paper 6 is pulled. The printer 3 has a recording paper storage portion 3*a*, pairs of guide rollers 7*a* and 8*a*, a detection portion 9 for detecting pulling of the paper 6, and a printing portion 10. The top portion of the printer 3 is covered with a cover 11 to be opened or closed thereby. The storage portion 3*a* rotatably stores a roll of recording paper 6. The recording paper 6 is sandwiched between the rollers 7*a* and 8*a* which are rotated with friction when the recording paper 6 is pulled. A light-emitting elment 12 such as a light-emitting diode and a light-receiving element 13 such as a photodiode or a phototransistor in the detecting portion 9 detects the speed at which the recording paper 6 is pulled. As shown in FIG. 2, light emitted from the light-emitting element 12 is irradiated on the outer circumferential surface of one guide roller 7*a*, and light reflected from the guide roller 7*a* is received by the light-receiving element 13. Thus, the rotational speed of the roller 7*a* is detected so as to determine the pulling speed of the recording paper 6. The detecting portion 9 then produces a detection signal to be described later. In order to allow this detection operation, thin black and white stripes are axially formed by printing or etching in the outer circumferential surface of the guide roller 7*a*, as shown in FIG. 2. Changes in density of light received from the guide roller 7*a* corresponding to these black and white stripes are detected to determine the rotational speed of the guide roller 7*a*. The printing portion 10 is arranged between the pairs of guide rollers 7*a* and 8*a* and prints in accordance with the pulling speed of the recording paper 6. As shown in FIG. 2, the printing portion 10 has a printing head 14 such as a thermal printing head and a platen 15 (a paper press in the case of a thermal printer). In accordance with the detection signal from the detecting portion 9, the printing head 14 prints on the recording paper 6 passing between the printing head 14 and the platen 15.

Figure 3:
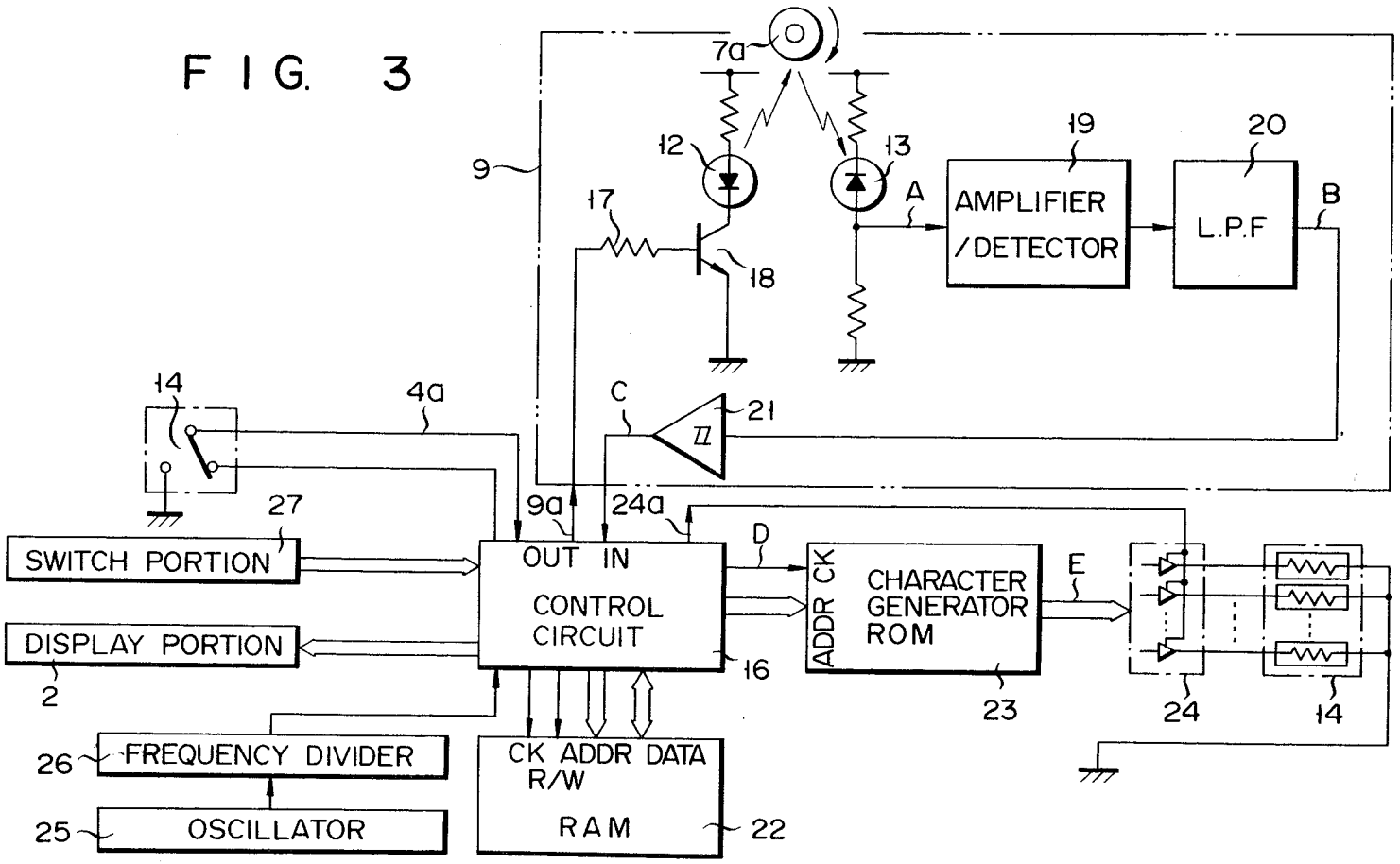
FIG. 3 is a block circuit diagram of the electronic wristwatch with a printer according to the present invention.
Figure 4:
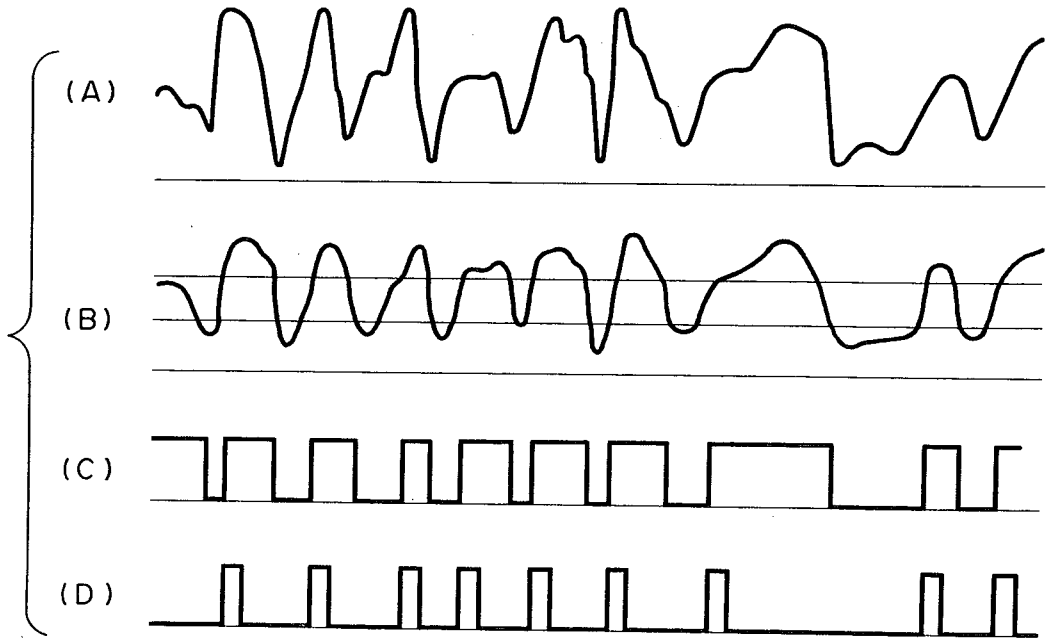
FIGS. 4(A) to 4(D) show waveforms at predetermined positions of the block circuit diagram shown in FIG. 3.
Figure 5:
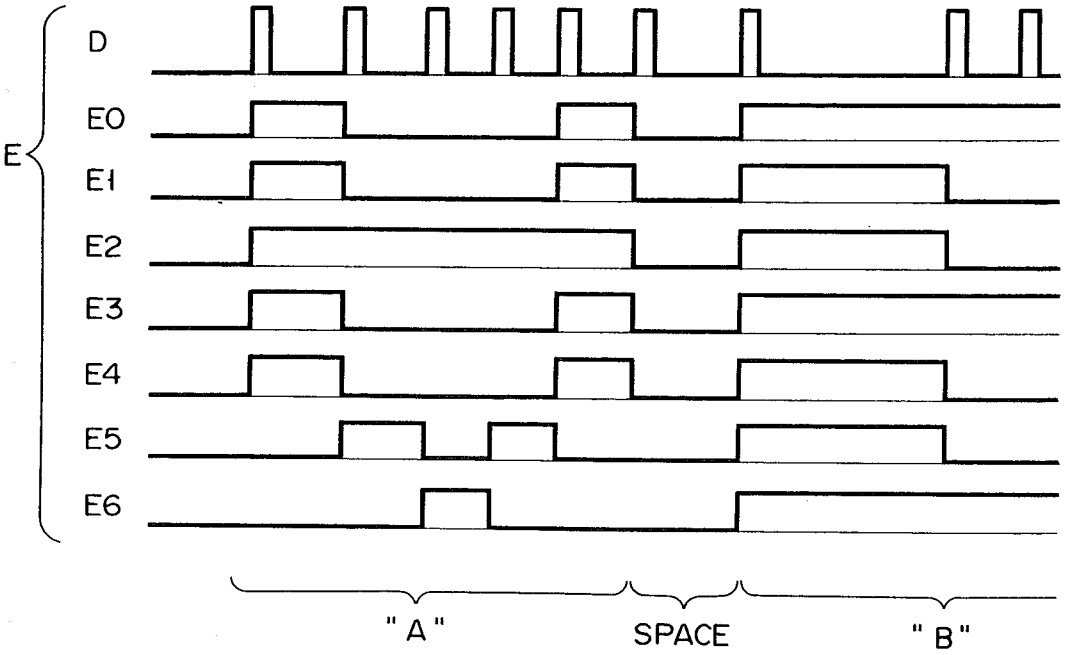
FIG. 5 is a timing chart of character signals generated by a character generator 23 shown in FIG. 3.

FIG. 3 shows the circuit configuration of the electronic wristwatch with a printer described above. The power source switch 4 is for turning on the printer function and supplies an ON/OFF signal to a control circuit 16. The control circuit 16 controls the overall circuit. In response to an ON signal 4*a* from the power source switch 4, the control circuit 16 supplies from its OUT terminal a drive signal 9*a* to the detecting portion 9. The drive signal 9*a* opens the gate of a transistor 18 through a resistor 17 of the detecting portion 9 and turns on the light-emitting element 12, which irradiates the outer circumferential surface of the guide roller 7*a* with light. Light reflected from the guide roller 7*a* is received by the light-receiving element 13 of the detecting portion 9. Then, a signal having a waveform A modulated as shown in FIG. 4(A) by the black and white stripes on the outer circumferential surface of the guide roller 7*a*, i.e., the rotational speed of the guide roller 7*a*, is supplied to an amplifier/detector 19. This signal is amplified/detected by the amplifier/detector 19. The upper and lower portions of an output signal from the amplifier/detector 19 are cut off by a low-pass filter (L.P.F) 20 as shown in FIG. 4(B). An intermediate signal having a waveform B is supplied to a wave shaper 21. The wave shaper 21 produces a rectangular wave C as shown in FIG. 4(C), which is supplied to an IN terminal of the control circuit 16 as a detection signal. In response to the detection signal, the control circuit 16 supplies a clock pulse, a read-write signal, and an address signal to a RAM 22 to exchange data therewith. At the same time, the control circuit 16 supplies to a character generator ROM 23 an address signal and a clock pulse D (FIG. 4(D)) at the leading edge of the rectangular wave C shaped by the wave shaper 21. The clock pulse D has a pulse width corresponding to the rotational speed of the guide roller 7*a*, i.e., the pulling speed of the recording paper 6. When the speed is high, the pulse interval is wide, and when it is low, the pulse interval is narrow. In response to the address signal and the clock pulse D from the control circuit 16, the character generator ROM 23 prepares printing data E and supplies it to a driver 24, as shown in FIG. 3. As shown in FIG. 5, the printing data E consists of pulse signals E0 to E6, and each pulse is generated in accordance with the clock pulse D. One character is generated per 6 clock pulses D. The interval between the sixth and seventh clock pulses corresponds to a space between characters. In response to the printing data E and a drive signal 24*a* from the control circuit 16, the driver 24 supplies a drive signal corresponding to the pulse signals E0 to E6 of the printing data E to the printing head 14 to drive it. Then, the printing head 14 prints a predetermined character in accordance with a pulling speed of the recording paper 6.

Normally, a reference clock signal of a predetermined frequency generated by an oscillator 25 is supplied to a frequency driver 26, which frequency divides it. This signal is then supplied to the control circuit 16. In accordance with these frequency divided signals, when the power source switch 4 is OFF, the control circuit 16 causes the display portion 2 to display time information. However, when a predetermined signal for time correction or display switch is supplied from a switch portion 27, the control circuit 16 performs a time correction or display switch of the display portion 2.

In the electronic wristwatch with a printer as described above, the pulling speed of the recording paper 6 is detected by the detecting portion 9. The printing head 14 is controlled in accordance with a detection signal from the detecting portion 9. Thus, the printing head 14 prints in accordance with the pulling speed of the recording paper 6. Therefore, a paper feed motor required in a conventional wristwatch is not required, power consumption is low, the construction is simple, and the wristwatch is compact in size.

In the embodiment described above, the recording paper storage portion 3*a* is arranged inside the wristwatch case 1. However, the present invention is not limited to this. Thus, the recording paper 6 can also be arranged outside the wristwatch case 1 and is pulled through the printer 3. In this case, the wristwatch can be made even smaller.

Figure 6:
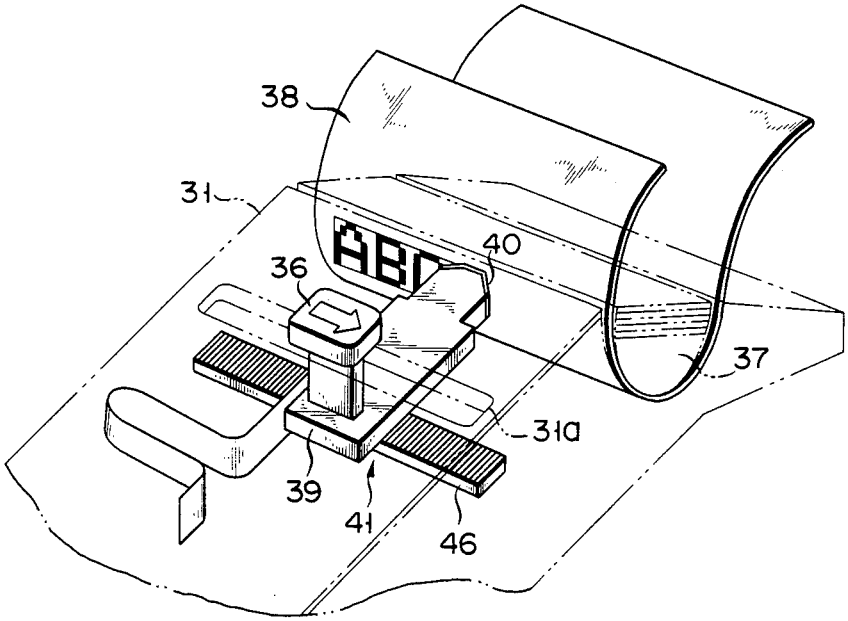
FIG. 6 is a perspective view showing the construction of the main part of a printer portion according to another embodiment of the present invention.
Figure 8A:
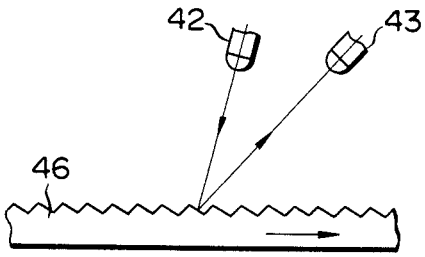
FIGS. 8(A) and 8(B) are views showing reflection of light among a light-emitting element, a reflector, and a light-receiving element.
Figure 8B:
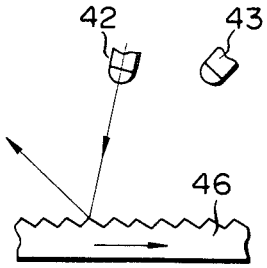
Figure 7:
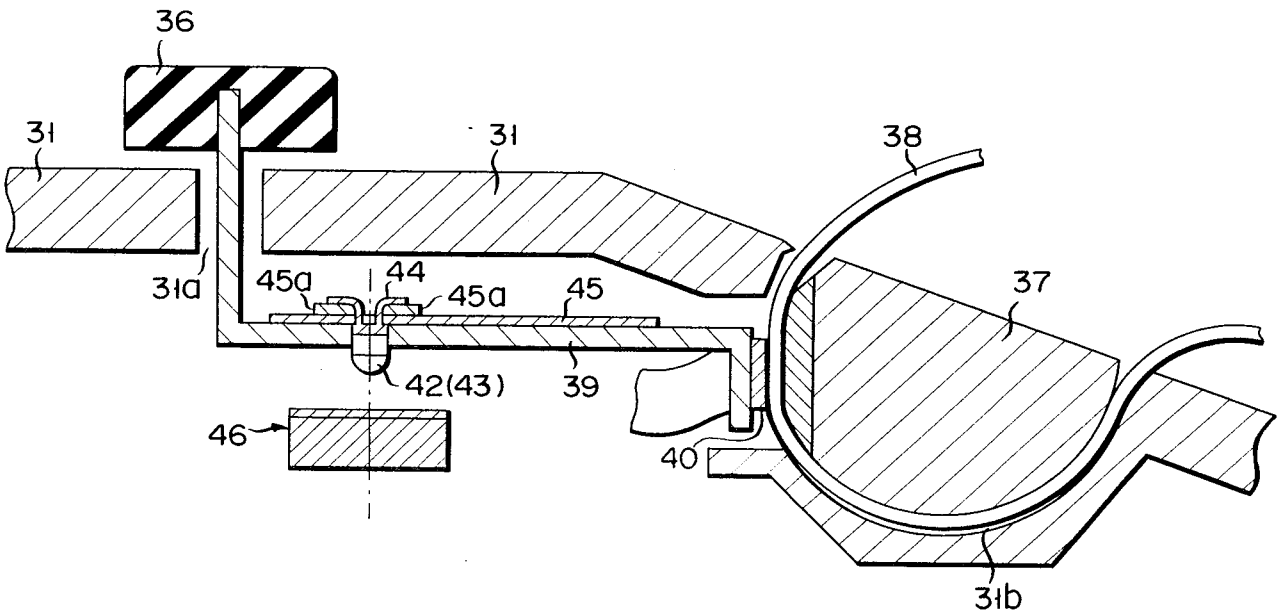
FIG. 7 is a longitudinal sectional view of a printer portion shown in FIG. 6.

FIGS. 6 to 8 show a printer portion according to another embodiment of the present invention. The printer portion prints predetermined information on recording paper 38 mounted in a holder 37 in accordance with an operation lever 36. The printer portion slides an operation lever 36 so as to move a printing head 40 through a moving member 39 along the recording paper 38 mounted in the holder 37. A moving position of the printing head 40 is detected by a detecting portion 41. In response to a detection signal from the detecting portion 41, printing data is supplied from a control circuit 47, to be described later, to the printing head 40, which prints accordingly. The moving member 39 is arranged inside the wristwatch case 31 and slides along the widthwise direction of the recording paper 38 held on the holder 37 in accordance with the operation of the operation lever 36. The printing head 40, the operation lever 36, and the detecting portion 41 are arranged so as to have predetermined distances among them. The printing head 40 is a head of a thermal printer or the like; it has a vertical array of a plurality of dots (printing elements) which print one character on the recording paper 38 upon being shifted by a distance corresponding to one character along the transverse direction. The operation lever 36 extends from the rear end of the moving member 39 and then upward through a guide groove 31*a* formed in the wristwatch case 31. When the projecting portion of the lever 36 is moved along the guide groove 31*a*, the lever 36 slides the printing head 40 along the moving member 39. While the detecting portion 41 moves together with the moving member 39, it detects the moving position of the printing head 40. As shown in FIG. 7, the detecting portion 41 has a light-emitting element 42 such as a light-emitting diode and a light-receiving element 43 such as a photodiode. The light-emitting element 42 and the light-receiving element 43 are arranged at the lower portion of the moving member 39 and contact metal electrodes 45*a* of a circuit board 45 formed on the upper surface of the moving member 39 through lead wires 44. Light emitted from the light-emitting element 42 is reflected by a reflector 46 below the elements 42 and 43, and the reflected light is received by the element 43. In this case, the reflector 46 is a plate elongated along the moving direction of the light-emitting element 42 and the light-receiving element 43 and is fixed inside the wristwatch case 1. The upper surface of the reflector 46 has a sawtooth-like surface, as shown in FIGS. 8(A) and 8(B). Therefore, the light-receiving element 43, which receives light from the light-emitting element 42 through the reflector 46, sequentially detects light which changes from the maximum to the minimum level in intensity in accordance with the teeth of the reflector 46 upon the movement of the moving member 39. In this manner, the light-receiving element 43 detects the amount of movement (moving position) of the printing head 40. The amount of light received from each tooth of the reflector 46 is maximum in the state shown in FIG. 8(A) and is minimum in the state shown in FIG. 8(B).

The holder 37 holding the recording paper 38 therein is a rod member of a semiarcuated shape having one pivotal end. The holder 37 is located inside a groove 31*b* formed in the wristwatch case 31 and holds the recording paper 38 inside the groove 31*b*.

Figure 9:
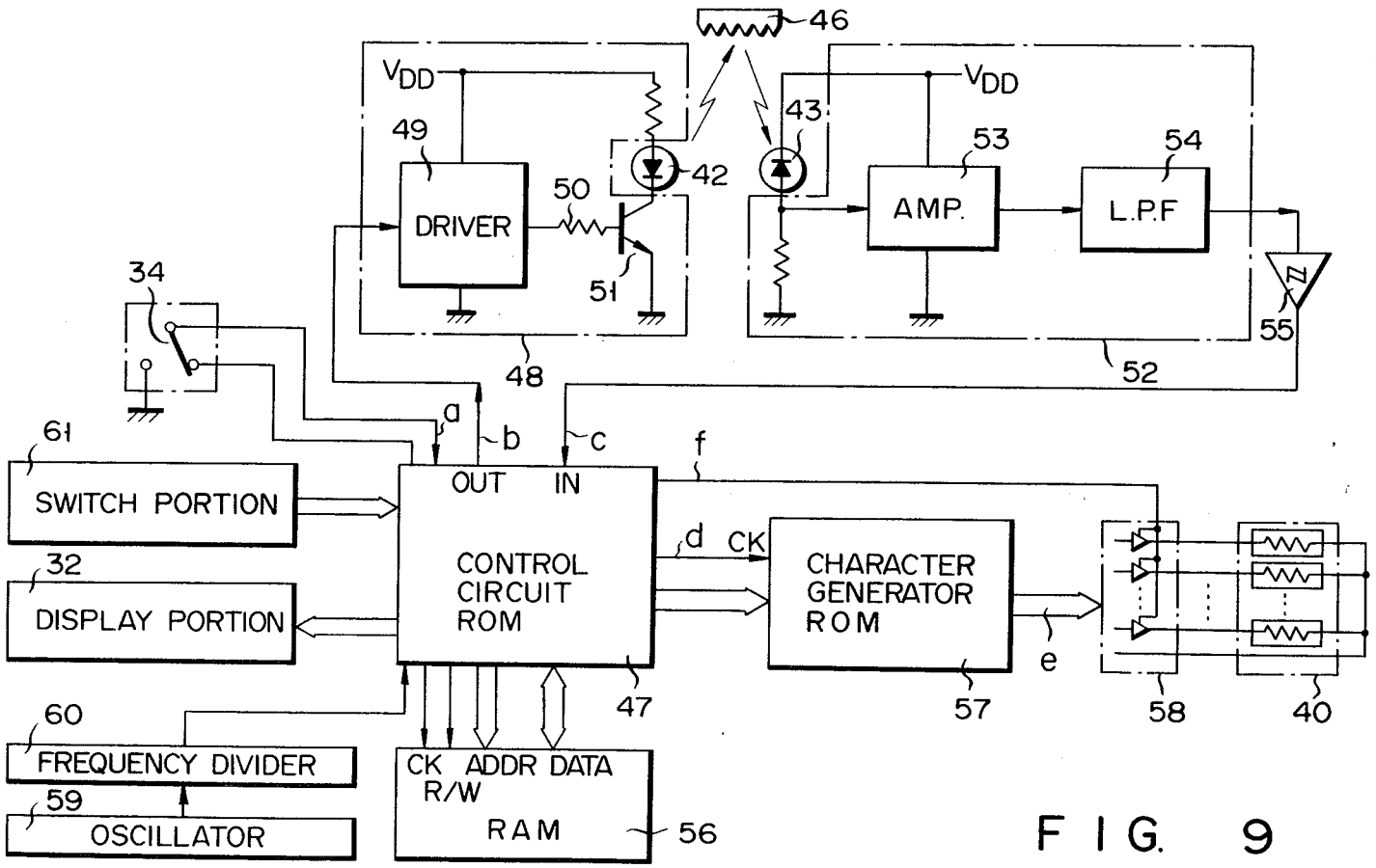
FIG. 9 is a block circuit diagram of an electronic wristwatch with a printer according to the embodiment shown in FIG. 6.

FIG. 9 is a circuit block diagram of the electronic wristwatch with a printer shown in FIG. 6. An ON/-OFF switch 34 switches between the timepiece mode and the printer mode. When the switch 34 is ON, the printer mode is set. A control circuit 47 controls the overall circuit. When an ON signal a is supplied from the switch 34, the control circuit 47 supplies from its OUT terminal a drive signal b to a light-emitting element driving circuit 48. The light-emitting element driving circuit 48 drives the light-emitting element 42. When the drive signal b is received from the OUT terminal of the control circuit 47, the driver 49 opens the gate of a transistor 51 through a resistor 50 and applies a predetermined voltage to the light-emitting element 42. Light emitted from the light-emitting element 42 is then irradiated onto the reflector 46, and the reflected light changes in intensity for each tooth of the reflector 46 as the moving member 39 and the printing head 40 are moved by the operation of the operation lever 36. The light thus changing in intensity is received by the light-receiving element 43. The light-receiving element 43 converts changes in the amount of light received per tooth of the reflector 46 into an electrical signal and supplies the electrical signal to a light-receiving element input amplifier 52. The input amplifier 52 amplifies/detects the modulated waveform signal from the light-receiving element 43 by an amplifier 53. A low-pass filter (L.P.F) 54 cuts off the upper and lower portions of the signal from the amplifier 53, and a wave shaper 55 shapes the signal into a rectangular wave. The rectangular wave is then supplied as a detection signal c to the IN terminal of the control circuit 47. In response to the signal c, the control circuit 47 supplies a clock pulse, a read/write signal, and an address signal to a RAM 56 to exchange data therewith. At the same time, the control circuit 47 supplies printing data stored in a RAM 56 and a clock pulse d to a character generator ROM 57. In response to the printing data and the clock pulse d received from the control circuit 47, the character generator ROM 57 prepares a character signal e and supplies it to a driver 58. The printing data e is time-division dot data corresponding to each vertical dot array. The printing data is generated for each address in accordance with the clock pulse d and is sequentially supplied to the driver 58. Each time a drive signal f is received from the control circuit 47, the driver 58 drives each dot of the vertical array (printing elements) of the printing head 40 in accordance with the character signal e so as to print the corresponding character. In this case, the drive signal f and the clock pulse d are synchronous with the detection signal c. Therefore, when the operation lever 36 is moved quickly, the printing head 40 prints quickly, and when the operation lever 34 is moved slowly, the printing head 40 prints slowly. Characters are always printed in the same size.

An oscillator 59 supplies reference clock signals to a frequency divider 60 which normally supplies the frequency divided signals to the control cirucit 47. When the switch 34 is in the timepiece mode, the control circuit 47 causes the display portion 32 to display time information. However, when a predetermined signal is supplied from a switch portion 61 requesting a time correction or display switch, the control circuit 47 performs the time correction or display switch of the display portion 32. Printing data stored in the RAM 56 is supplied from the switch portion 61. Printing data includes various data such as a telephone number or the name of a person.

In the electronic wristwatch with a printer as described above, when the operation lever 36 shown in FIG. 6 is slid along the guide groove 31*a*, the printing head 40 is moved along the recording paper 38. At the same time, the light-emitting element 42 and the light-receiving element 43 of the detecting portion 41 are moved along the reflector 46. The light received by the reflector 46 is intensity-modulated in accordance with each tooth of the reflector 46, and the thus modulated, reflected light is received by the light-receiving element 43. The moving speed of the operation lever 36 and hence the printing head 40 is detected. Printing data is then supplied to the printing head 40 through the control circuit 47 and the character generator ROM 57 in accordance with a detection signal obtained in this manner. Therefore, predetermined printing can be performed in accordance with the moving speed of the printing head 40. A motor conventionally required for driving the printing head 40 or the recording paper 38 is not required, power consumption is decreased, the wristwatch structure is simplified, and the wristwatch can be rendered compact in size.

Figure 10A:
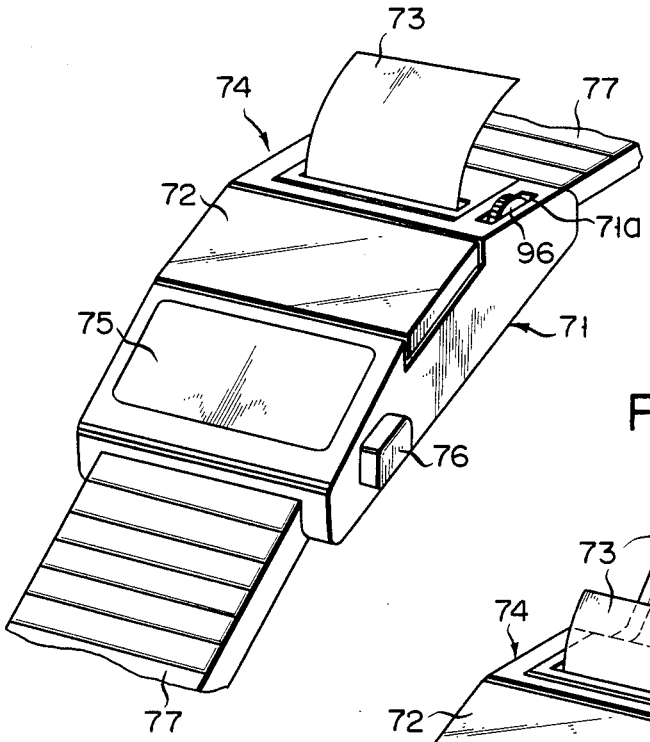
FIG. 10(A) is a perspective view showing the outer appearance of an electronic wristwatch with a printer according to still another embodiment of the present invention.
Figure 10B:
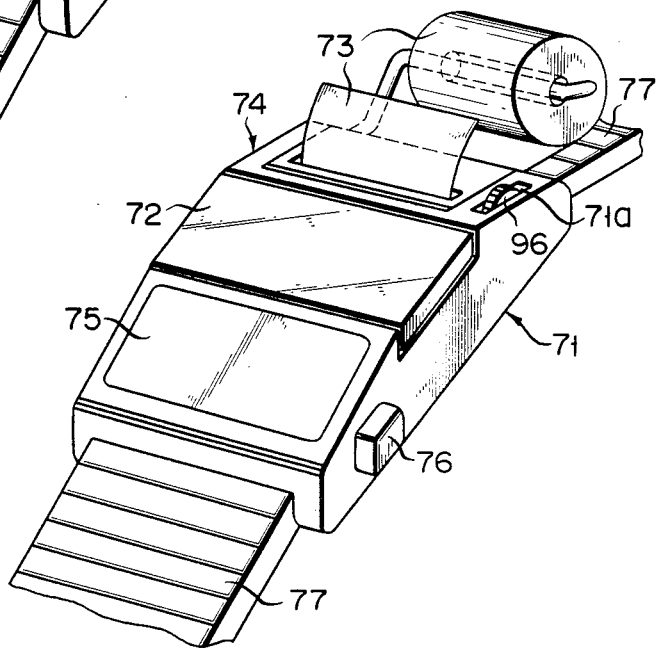
FIG. 10(B) is a perspective view showing the outer appearance of an electronic wristwatch with a printer according to still another embodiment of the present invention, wherein recording paper is supported outside a wristwatch case in the embodiment shown in FIG. 10(A)

FIGS. 10(A) and 10(B) show an electronic wristwatch according to still another embodiment of the present invention. FIG. 10(A) is a perspective view showing the outer appearance of the wristwatch wherein recording paper is housed inside a wristwatch case, and FIG. 10(B) is a perspective view showing the outer appearance of the wristwatch wherein recording paper is supported outside the wristwatch case. The wristwatch has a printer function and the like in addition to the timepiece function. A display portion 72 for displaying information such as time information is arranged at the center of a watch case 71. A printer portion 74 for printing on recording paper 73 is arranged at the upper side of the watch case 71. A handwriting input portion 75 for inputting display information is arranged at the lower side of the watch case 71. An ON/OFF switch 76 for switching between the timepiece function and the printer function is arranged at a side wall of the watch case 71. Watch bands 77 are mounted to the front and rear walls of the watch case 71.

Figure 11A:
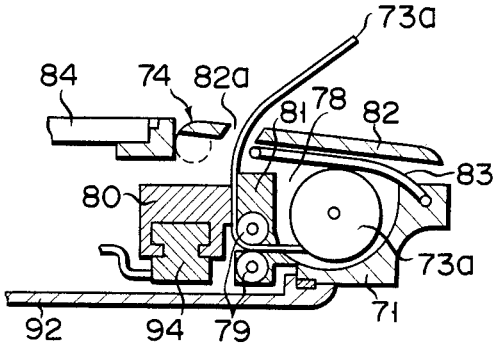
FIG. 11(A) is a sectional view of a printer portion shown in FIG. 10(A)
Figure 11B:
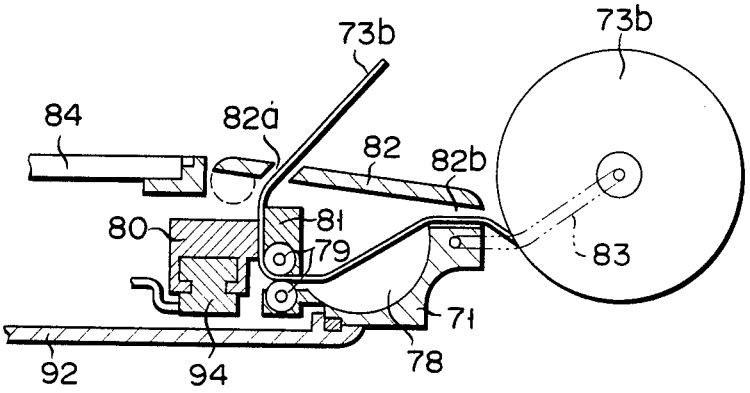
FIG. 11(B) is a sectional view of a printer portion shown in FIG. 10(B)

FIGS. 11(A) and 11(B) show different mounting states of the recording paper 73. FIG. 11(A) is a sectional view of the printer portion 74 shown in FIG. 10(A), and FIG. 11(B) is a sectional view of the printer portion 74 shown in FIG. 10(B). A recording paper storage portion 78 for storing the recording paper 73 is arranged inside the printer portion 74 shown in FIG. 11(A). The storage portion 78 stores a roll of recording paper 73*a* having a small diameter, as shown in FIG. 11(A). The recording paper 73*a* stored in the storage portion 78 is fed to a position between a printing head 80 and a paper press (platen) 81 by paper feed rollers 79. After printing data is printed on the paper 73*a*, the paper 73*a* is fed out through an outlet port 82*a* of a cover 82. Meanwhile, a roll of recording paper 73*b* of a large diameter is supported outside the watch case 71 through a support rod 83. The recording paper 73*b* is fed into the storage portion 78 through an inlet portion 82*b* between the cover 82 and the watch case 71. After the recording paper 73*b* is passed between the printing head 80 and the paper press 81 by the paper feed rollers 79, it is fed out through the outlet port 82*a* of the cover 82. In this case, the support rod 83 is pivotally mounted in the inner wall at the end of the watch case 71. When the support rod 83 is not used, the cover 82 is opened to store only the support rod 83 inside the printer portion 74, as indicated by the broken line in FIG. 11(A).

Figure 12:
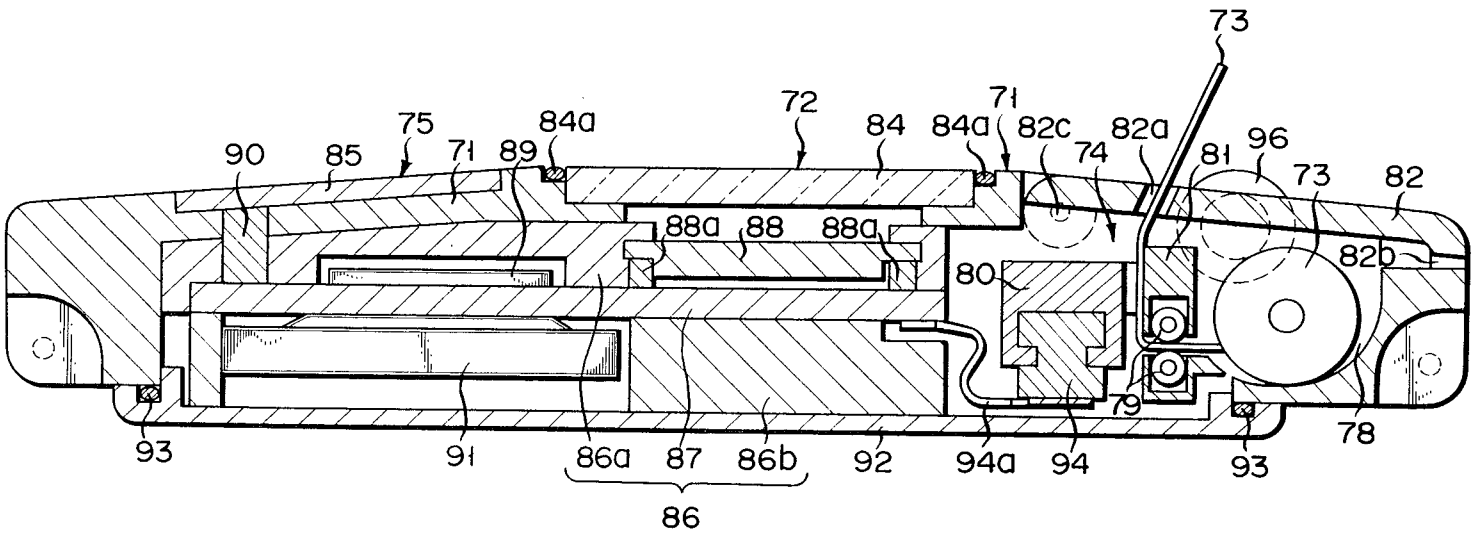
FIG. 12 is a sectional view showing the overall electronic wristwatch with a printer including the printer portion shown in FIG. 11(A)

FIG. 12 is a sectional view showing the overall internal configuration of the electronic wristwatch. A glass plate 84 is mounted in the upper surface of the watch case 71 through a packing 84*a* at a position corresponding to the display portion 72. A tablet 85 is mounted at a portion corresponding to the handwriting input portion 75. When the upper surface of the tablet 85 is activated by a finger, information of a character thus written is inputted. A module 86 is arranged at that portion inside the watch case 71 which corresponds to the glass plate 84 and the tablet 85. A circuit board 87 is arranged between an upper housing 86*a* and a lower housing 86*b* of the module 86. A liquid crystal display device 88 is connected on the upper surface of the circuit board 87 through interconnectors 88*a*. An electronic part 89 such as an LSI is also arranged on the upper surface of the circuit board 87. An interconnector 90 is arranged at the leftmost end of the upper surface of the circuit board 87. The liquid crystal display device 88 displays information such as time and corresponds to the glass plate 84. The interconnector 90 electrically connects the circuit board 87 and the tablet 85 and extends from the upper surface of the circuit board 87 to be in contact with the lower surface of the tablet 85 through the upper housing 86*a* and the watch case 71. A battery 91 is arranged below the lower surface of the circuit board 87. A rear cover 92 is mounted on the lower portion of the watch case 71 through a water-impermeable ring 93.

Figure 13:
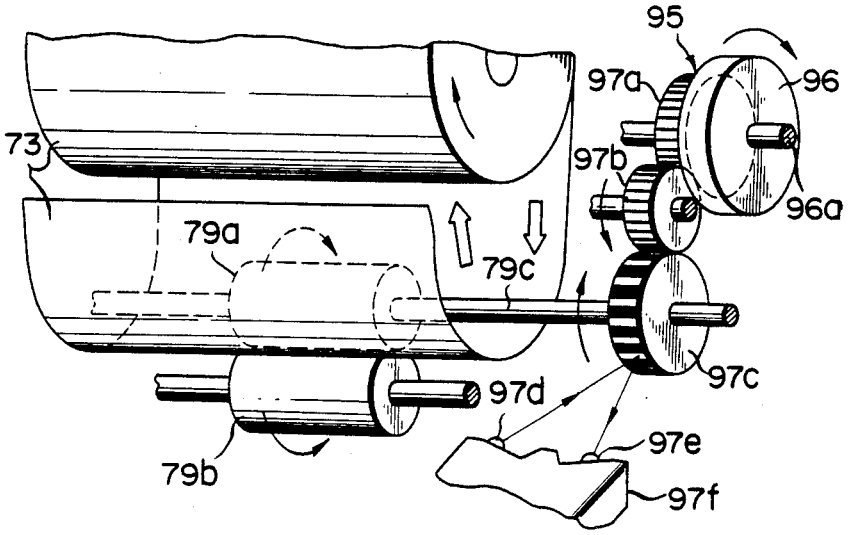
FIG. 13 is a view showing the construction of a paper feed mechanism in FIGS. 11(A) and 11(B)

The printer portion 74 is arranged to the right of the watch case 71. As described above, the printer portion 74 has the storage portion 78, the paper feed rollers 79, the printing head 80, the paper press 81, and an ultrasonic motor 94, which are all arranged inside the watch case 71. The cover 82 is mounted at the upper portion of the watch case 71. The storage portion 78 stores the recording paper 73 and is arranged at the right side inside the watch case 71. The paper feed rollers 79 are manually driven through a paper feed mechanism 95, as shown in FIG. 13, and feed the recording paper 73 stored inside the storage portion 78 to the position between the printing head 80 and the paper press 81. The paper feed rollers 79 are vertically opposed to each other inside the storage portion 78. The printing head 80 prints on the recording paper 73 in accordance with printing data and is mounted on the ultrasonic motor 94. The paper press 81 presses the recording paper 73 to the printing head 80. For this purpose, the paper press 81 is arranged above the paper feed rollers 79 and opposes the printing head 80. As will be described later, the ultrasonic motor 94 moves the printing head 80 in accordance with an input drive signal. The ultrasonic motor 94 is arranged in opposition to the paper feed rollers 79 and is connected to the circuit board 87 through a lead wire 94*a*. The cover 82 covers the upper portion of the printer portion 74 so as to be able to open or close and is pivotally mounted on the upper portion of the watch case 71 through a hinge 82*c*. In this case, the cover 82 has the outlet port 82*a* for feeding the printed recorded paper 73 upward and the inlet port 82*b* for receiving the recording paper 73 inside the case 71. An opening 71*a* is formed in that portion of the watch case 71 which is near the cover 82 so as to receive an operation member 96 of the paper feed mechansm 95, as shown in FIGS. 10(A) and 10(B).

FIG. 13 shows the configuration of the paper feed mechanism 95. When the operation member 96 is manually operated, the paper feed mechanism 95 rotates the paper feed rollers 79 through a gear train 97 so as to feed the recording paper 73. The operation member 96 is a disc mounted on a rotating shaft 96*a* and partially projects upward through an opening 71*a* of the watch case 71, as shown in FIG. 10. The gear train 97 consists of a gear 97*a* mounted on the rotating shaft 96*a* of the operation member 96 for rotation therewith, an intermediate gear 97*b* meshing and rotating with the gear 97*a*, and a driven gear 97*c* meshing and rotating with the intermediate gear 97*b*. The driven gear 97*c* is mounted on a shaft 79*c* of the upper paper feed roller 79*a*. Therefore, when the operation member 96 is rotated by fingers, the gears 97*a*, 97*b* and 97*c* of the gear train 97 are rotated to rotate the upper paper feed roller 79*a*. When the upper paper feed roller 79*a* is rotated, the lower paper feed roller 79*b* in contact therewith is also rotated. Thus, the recording paper 73 is sandwiched between the upper and lower paper feed rollers 79*a* and 79*b* to be fed thereby.

Black and white stripes are alternately formed on the outer circumferential surface of the gear 97*c*. The rotation of the gear 97*c* is detected by a detecting portion 97*f* having a light-emitting element 97*d* and a light-receiving element 97*e*. The detection signal is processed by an electronic circuit to be described later.

Figure 14:
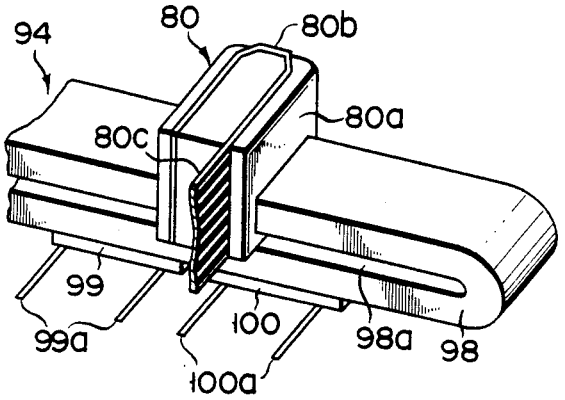
FIG. 14 is a perspective view showing the construction of a main part of an ultrasonic motor shown in FIG. 12.
Figure 15:
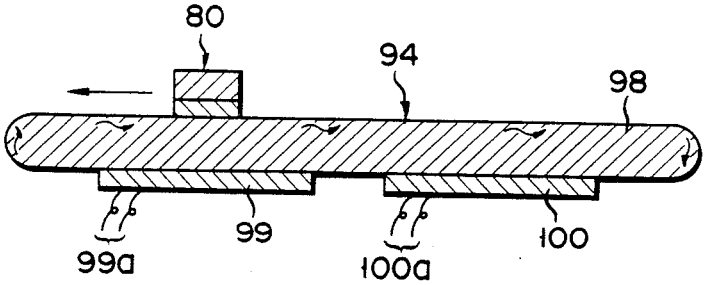
FIG. 15 is a sectional view for explaining the operation principle of the ultrasonic motor shown in FIG. 14.
Figure 16:
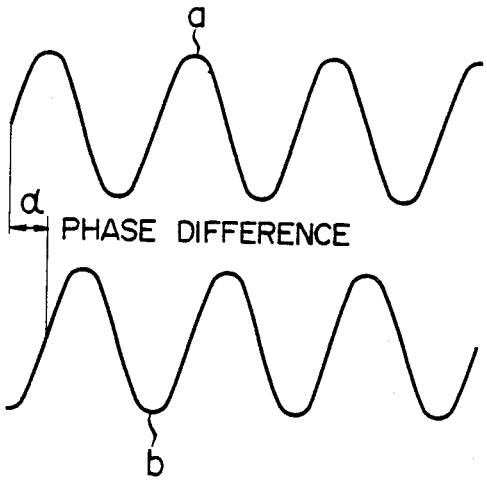
FIG. 16 shows the waveform for explaining the operational principle shown in FIG. 15.

FIGS. 14 to 16 show the construction of the ultrasonic motor 94. FIG. 14 is a perspective view showing the outer appearance of the motor, FIG. 15 shows the operation principle, and FIG. 16 shows the waveform. The ultrasonic motor 94 moves the printing head 80 utilizing the vibration of a piezoelectric element. As shown in FIG. 14, the ultrasonic motor 94 comprises a guide rail 98 for movably supporting the printing head 80 and two piezoelectric elements 99 and 100 arranged on the lower surface of the guide rail 98. In this case, the printing head 80 comprises a head support 80*a*, a head portion 80*b* such as a thermal head arranged at the distal end of the head support 80*a*, and a wiring 80*c* for supplying printing data to the head portion 80*b*. The lower end portion of the head support 80*a* is mounted at the upper portion of the guide rail 98. More particularly, the lower end portion of the head support 80*a* is fitted in mounting grooves 98*a* formed in two side walls of the guide rail 98. When a predetermined voltage is applied to the piezoelectric elements 99 and 100, they vibrate. Lead terminals 99*a* and 100*a* of the piezoelectric elements 99 and 100 are connected to the circuit board 87 through the lead wire 94*a* as shown in FIG. 12. In this case, the voltage waveforms a and b of the voltages applied to the piezoelectric elements 99 and 100 have a phase difference $\alpha$. Therefore, the piezoelectric elements 99 and 100 vibrate in different phases. In this manner, when the piezoelectric elements 99 and 100 vibrate in the different phases, the printing head 80 is moved along the guide rail 98 due to the vibration phase difference, as shown in FIG. 15.

Figure 17:
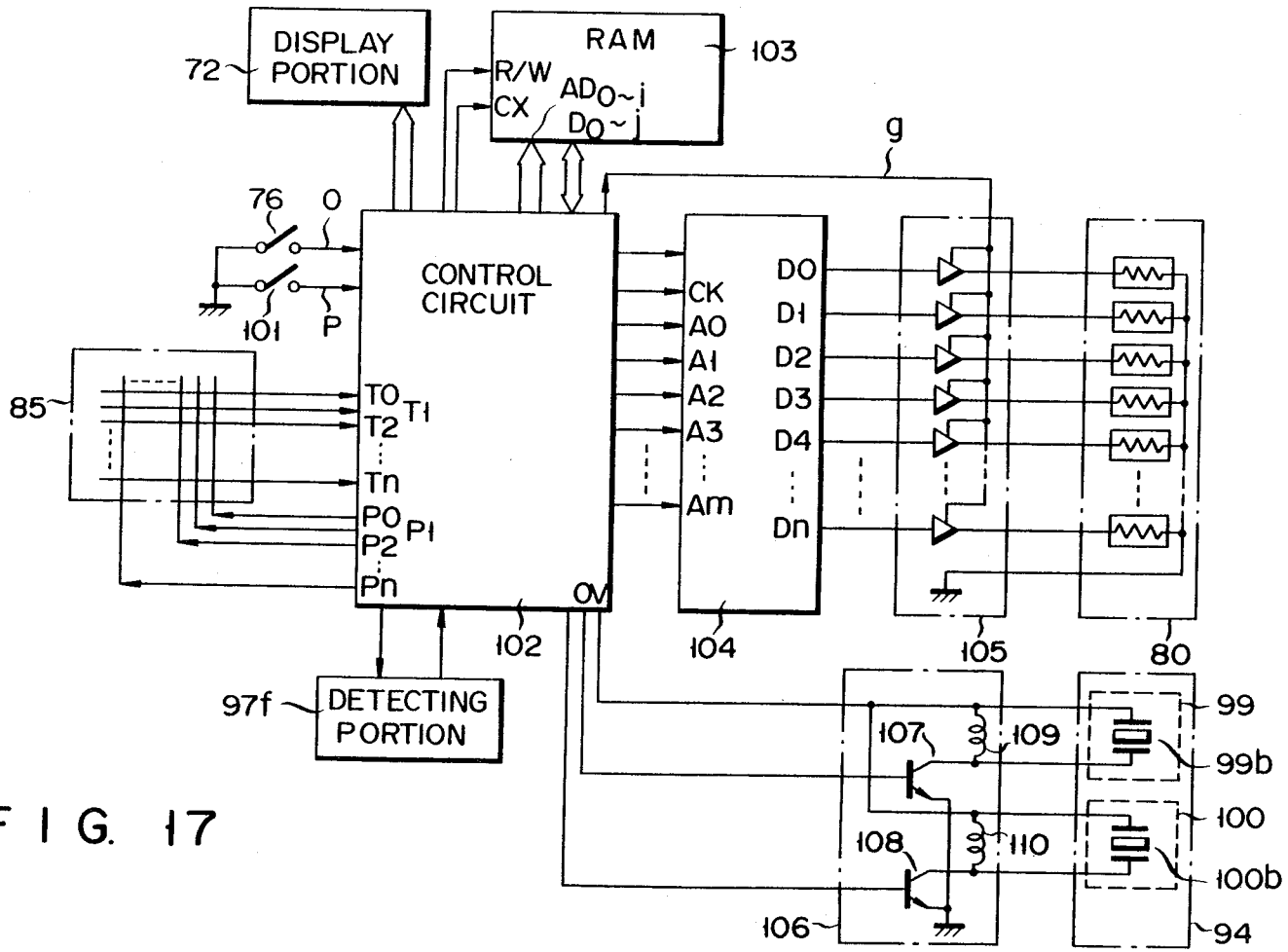
FIG. 17 is a block circuit diagram showing an electronic wristwatch with a printer according to still another embodiment of the present invention.

FIG. 17 is a block diagram showing the circuit arrangement of the electronic wristwatch described above. The ON/OFF switch 76 switches between a timepiece function and a printer function. A switch 101 corrects the time. The ON/OFF switch 76 and the switch 101 supply ON/OFF signals o and f to a control circuit 102. The control circuit 102 controls the overall operation of the circuit. When the ON/OFF switch 76 is kept off, the control circuit 102 supplies time data to the display portion 72 and causes the display portion 72 to display the normal time. When the switch 101 is turned on, the time displayed on the display portion 72 is corrected. Furthermore, when the ON/OFF switch 76 is turned on, the control circuit 102 supplies pulse signals P0 to Pn to the tablet 85 in the handwriting input portion 75. When a character or the like is drawn on the tablet 85, corresponding input data T0 to Tn are supplied to the control circuit 102. When the input data T0 to Tn are supplied from the tablet 85 to the control circuit 102, the control circuit 102 detects one handwritten character and supplies a read/write signal, a clock pulse and an address signal to a RAM 103 to exchange data therewith. The control circuit 102 supplies a select signal e, a clock pulse f and printing data A0 to Am to a character generator 104. The character generator 104 generates printing character signals D0 to Dn in response to the select signal e, the clock pulse f and the printing data A0 to Am. The printing character signals D0 to Dn are supplied to a driver 105. The printing character signals D0 to Dn are time-division dot data and are produced in units of addresses in accordance with the clock pulse f. The driver 105 drives the corresponding dots of the printing head 80 in accordance with the printing character signals D0 to Dn every time it receives a drive signal g from the control circuit 102, thereby printing a character. Drive signals h and i are supplied through a driver 106 from the control circuit 102 to the ultrasonic motor 94 for moving the printing head 80. The drive signals h and i have a phase difference $\alpha$ in the same manner as in FIG. 16. The drive signals h and i enable the gates of transistors 107 and 108 of the driver 106, respectively. Each of the drive signals is supplied to one terminal of the corresponding piezoelectric element 99 or 100. In this case, the other terminal of each of the piezoelectric elements 99 and 100 is connected to the ground (0 V) terminal of the control circuit 102. Coils 109 and 110 are connected in parallel with the piezoelectric elements 99 and 100 in the driver 106. Therefore, when the drive signals h and i are supplied to the piezoelectric elements 99 and 100, respectively, the piezoelectric elements 99 and 100 vibrate in different phases by means of capacitors 99*b* and 100*b* and the coils 109 and 110, respectively. The ultrasonic motor 94 moves the printing head 80. When one character is printed, the printing head 80 is stopped. When the next character is entered by handwriting, the printing head 80 is moved again. The clock pulse f and the drive signal g are synchronized with the drive signals h and i. The printing head 80 is moved every time one character is handwritten. When the operation member 96 is manually rotated to feed out the recording paper 73, feeding of paper is detected by the detecting portion 97*f*, and the detection signal is supplied from the detecting portion 97*f* to the control circuit 102.

Figure 18:
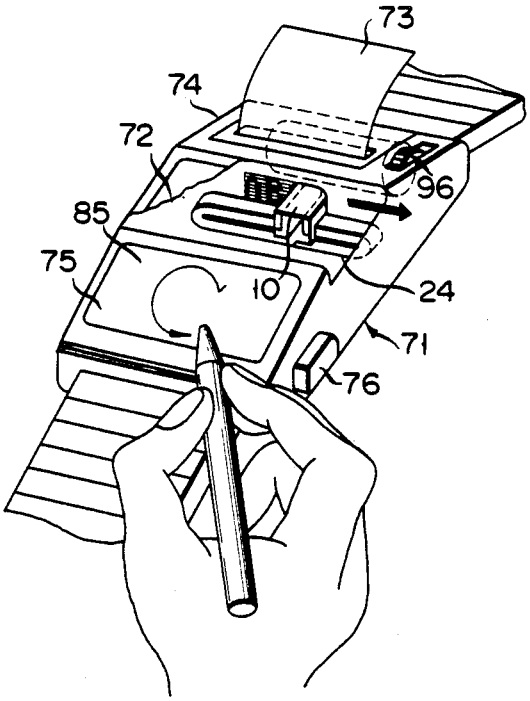
FIG. 18 is a perspective view showing the outer appearance of the electronic wristwatch with a printer for explaining the printer function.

A case will be described with reference to FIGS. 18 and 19, wherein the electronic wristwatch is used in the printer mode.

In this case, the ON/OFF switch 76 arranged on the side wall of the watch case 71 is depressed to set the wristwatch in the printer mode. In this state, as shown in FIG. 18, when a character is manually drawn on the tablet 85 of the handwriting input portion 75, the drawn character is entered as input data T0 to Tn to the control circuit 102. The control circuit 102 detects that the character is entered by handwriting and supplies the printing data A0 to Am to the printing head 80. The control circuit 102 also supplies the drive signals h and i to the ultrasonic motor 94. The printing head 80 is moved by the ultrasonic motor 94 to print the character written on the tablet 85. This character is printed on the recording paper 73.

Figure 19:
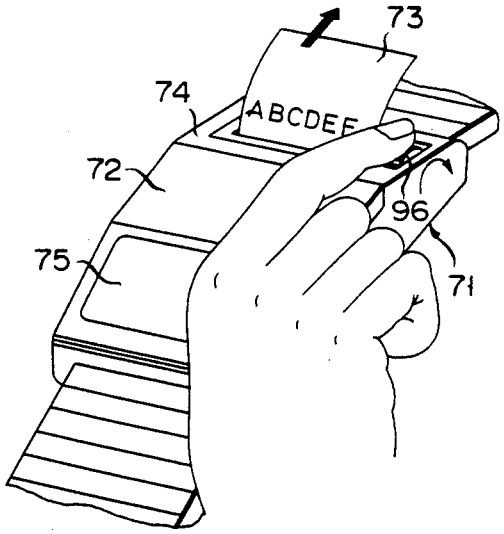
FIG. 19 is a perspective view showing the state wherein printed recording paper is pulled from the electronic wristwatch with a printer shown in FIG. 18.

In this manner, when one-line characters are sequentially printed on the recording paper 73 and the operation member 96 slightly extending upward from the cover 82, as shown in FIG. 19, is turned manually, the recording paper 73 is fed out through the paper feed rollers 79. At the same time, a signal is supplied from the detecting portion 97*f* to the control circuit 102. As a result, the printing head 80 is returned to the initial position and is ready for the next printing.

When the electronic wristwatch is used in the timepiece mode, the ON/OFF switch 76 is depressed and is turned off, and then the normal time is displayed on the display portion 72.

According to the electronic wristwatch with a printer of the present invention, the control circuit 102 detects when one handwritten character is entered. In this manner, when one character is written quickly, printing can be performed quickly.

Furthermore, since the printing head 80 is directly moved by the ultrasonic motor 94 by using the piezoelectric elements 99 and 100 in accordance with the drive signals h and i from the control circuit 102, a converting mechanism need not be used unlike the case of the conventional apparatus. As a result, the electronic wristwatch according to the present invention has a simple, compact construction. Furthermore, the recording paper 73 can be housed in the recording paper storage portion 78 in the watch case 71 or can be set on the support rod 83 arranged outside the watch case 71. The size of the recording paper 73 is not therefore limited to the watch size, but can be extended to any length.

Figure 20:
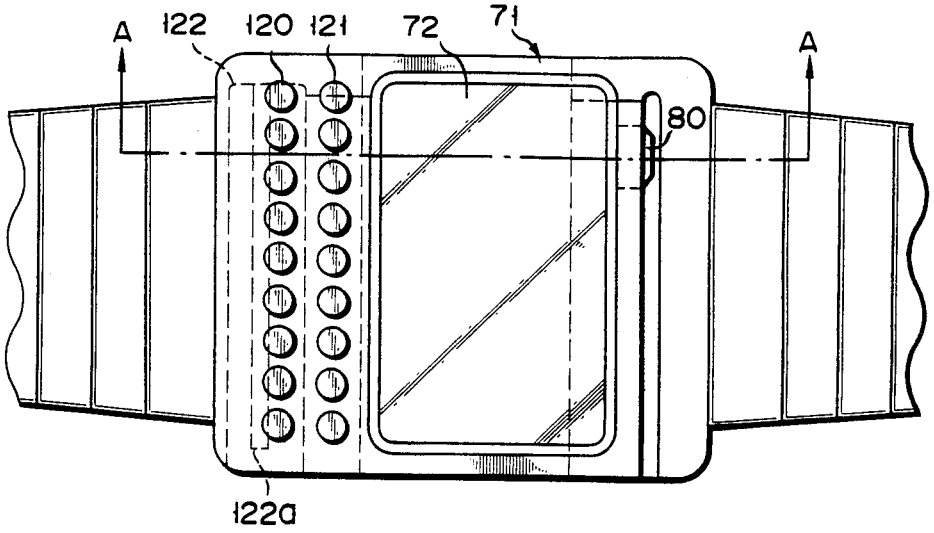
FIG. 20 is a plan view of the electronic wristwatch with a printer according to the present invention.
Figure 21:
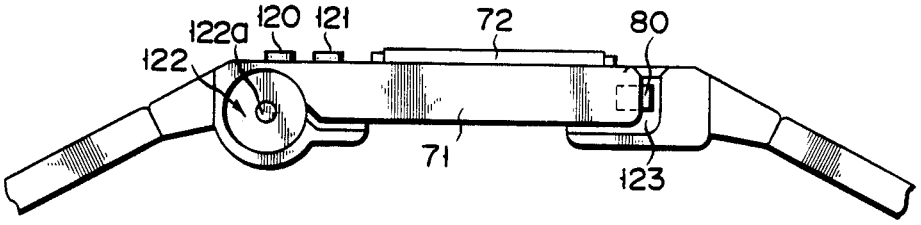
FIG. 21 is a side view of the electronic wristwatch with a printer shown in FIG. 20.
Figure 22:
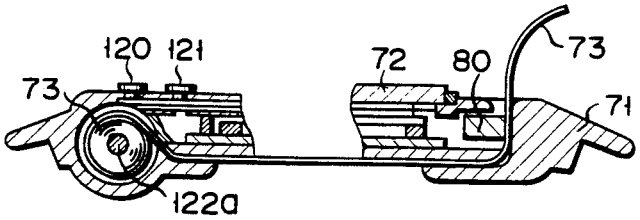
FIG. 22 is a sectional view along the line A—A in FIG. 20.

FIGS. 20 to 22 are respectively a plan view, a side view, and a partial sectional view showing an electronic wristwatch with a printer according to another embodiment of the present invention. A keyboard having ten keys 120 and alphanumeric keys 121 is used in place of the handwriting tablet of the electronic wristwatch in FIG. 10. Recording paper 73 is housed in a recording paper storage portion 122 of a case 71 formed below the keyboard. A support rod 122*a* is arranged in the storage portion 122 to rotate the recording paper therearound. The recording paper 73 passes by the lower surface of the case and is subjected to printing by a printing head 80 at an opening 123 through which the recording sheet passes. The printing paper is then fed out onto the upper surface of the case 71. Other arrangements in this embodiment are the same as those in FIG. 10.

With this construction, the recording paper can be easily removed/loaded. Furthermore, the printer is constituted by effectively utilizing the upper and lower portions of the watch case, thereby providing a compact wristwatch.

In the respective embodiments described above, the data to be printed is not described in detail. However, current time data obtained by a timepiece circuit, alarm time data, stop watch time data, and numeric and character data (e.g., telephone numbers, addresses and names) entered at the tablet 85 or the keyboard can be directly or temporarily stored in the RAM and can be accessed at any time.

What is claimed is:

1. An electronic wristwatch with a printer comprising:

a wristwatch case means having a recording paper loading portion;

a printing head means, arranged inside said wristwatch case, for printing on the recording paper;

an operation member means, manually operated, for moving said printing head means;

detecting means for detecting a displacement of said printing head which is performed by manual operation of said operation member; and print controlling means for controlling the printing of said printing head at a speed corresponding to the displacement detected by said detecting means.

2. An electronic wristwatch according to claim 1, wherein said detecting means comprises optical detecting means.

3. An electronic wristwatch with a printer comprising:

a wristwatch case means having a recording paper loading portion;

a printing head means, arranged inside said wristwatch case, for printing on recording paper;

detecting means for detecting a displacement of the recording paper manually fed out; and print controlling means for controlling the printing of said printing head at a speed corresponding to the displacement detected by said detecting means.

4. An electronic wristwatch according to claim 3, wherein said detecting means comprises optical detecting means.

5. An electronic wristwatch with a printer comprising:

a wristwatch case means having a recording paper loading portion;

a printing head means, arranged inside said wristwatch case, for performing printing on recording paper;

input means for entering character data to be printed;

detecting means for detecting an input speed of the character data entered from said input means; and print controlling means for controlling printing of said printing head at a speed corresponding to the displacement detected by said detecting means.

6. An electronic wristwatch according to claim 5, wherein said input means comprises handwriting input means, and said detecting means comprises means for detecting that one handwritten character is entered.

* * * * *